US006666754B1

(12) United States Patent
Beckage

(10) Patent No.: US 6,666,754 B1
(45) Date of Patent: Dec. 23, 2003

(54) METHOD AND APPARATUS FOR DETERMINING CMP PAD CONDITIONER EFFECTIVENESS

(75) Inventor: Peter J. Beckage, Austin, TX (US)

(73) Assignee: Advanced Micro Devices, Inc., Austin, TX (US)

( * ) Notice: Subject to any disclaimer, the term of this patent is extended or adjusted under 35 U.S.C. 154(b) by 0 days.

(21) Appl. No.: 09/484,604

(22) Filed: Jan. 18, 2000

(51) Int. Cl.[7] ..... B24B 1/00
(52) U.S. Cl. ..... 451/56; 451/5; 451/443
(58) Field of Search ..... 451/41, 6, 5, 54, 451/56, 443, 444

(56) References Cited

U.S. PATENT DOCUMENTS 5,036,015 A * 7/1991 Sandhu et al. ..... 451/41
5,069,002 A * 12/1991 Sandhu et al. ..... 451/41
5,308,438 A * 5/1994 Cote et al. ..... 451/41
5,639,388 A * 6/1997 Kimura et al. ..... 451/41
5,743,784 A * 4/1998 Birang et al. ..... 451/56
5,851,135 A * 12/1998 Sandhu et al. ..... 451/6
5,899,792 A * 5/1999 Yagi ..... 451/6
6,004,188 A * 12/1999 Roy ..... 451/41
6,146,250 A * 11/2000 Nagabushnam et al. ..... 451/41
6,179,688 B1 * 1/2001 Beckage et al. ..... 451/41
6,186,864 B1 * 2/2001 Fisher, Jr. et al. ..... 451/6
6,194,231 B1 * 2/2001 Ho-Cheng et al. ..... 451/6

* cited by examiner

*Primary Examiner*—Joseph J. Hail, III
*Assistant Examiner*—Hadi Shakeri
(74) *Attorney, Agent, or Firm*—Williams, Morgan & Amerson, P.C.

(57) ABSTRACT

A method includes supplying a signal to rotationally drive a conditioning wheel of a conditioning tool. A polishing pad of a polishing tool is conditioned using the rotationally driven conditioning wheel. Changes in the signal driving the conditioning wheel during the conditioning process are monitored. A conditioning effectiveness of the conditioning wheel is determined based on the changes observed in the monitored signal. A system includes a conditioning tool and a controller. The conditioning tool is adapted to condition a polishing pad of a polishing tool. The controller is coupled to at least one of the polishing tool or the conditioning tool. The controller is adapted to supply a signal to rotationally drive a conditioning wheel of the conditioning tool, monitor changes in the signal driving the conditioning wheel during a conditioning process, and determine a conditioning effectiveness of the conditioning wheel based on changes observed in the monitored signal.

33 Claims, 9 Drawing Sheets

METHOD AND APPARATUS FOR DETERMINING CMP PAD CONDITIONER EFFECTIVENESS

BACKGROUND OF THE INVENTION

1. Field of the Invention

This invention relates generally to semiconductor processing, and more particularly, to a method and apparatus for determining chemical mechanical polishing (CMP) pad conditioner effectiveness.

2. Description of the Related Art

CMP is a widely used means of planarizing silicon dioxide as well as other types of processing layers on semiconductor wafers. Chemical mechanical polishing typically utilizes an abrasive slurry disbursed in an alkaline or acidic solution to planarize the surface of the wafer through a combination of mechanical and chemical action. Generally, a chemical mechanical polishing tool includes a polishing device positioned above a rotatable circular platen or table on which a polishing pad is mounted. The polishing device may include one or more rotating carrier heads to which wafers may be secured, typically through the use of vacuum pressure. In use, the platen may be rotated and an abrasive slurry may be disbursed onto the polishing pad. Once the slurry has been applied to the polishing pad, a downward force may be applied to each rotating carrier head to press the attached wafer against the polishing pad. As the wafer is pressed against the polishing pad, the surface of the wafer is mechanically and chemically polished.

During a polishing process, material may be abraded away from the surface of a wafer and deposited on the surface of the polishing pad. The build up of waste material on the surface of the polishing pad is commonly referred to as glazing. Glazing may, among other things, degrade the porosity of the polishing pad reducing the flow of slurry to the polishing process, thus, reducing the effectiveness of the polishing pad. Those skilled in the art will appreciate that a conditioning wheel may be used during a conditioning process to abrade the surface of a polishing pad (i.e., the conditioning wheel may be used during a conditioning process to remove the waste material and other debris from the surface of the polishing pad.)

As semiconductor devices are scaled down, the importance of chemical mechanical polishing to the fabrication process increases. In particular, it becomes increasingly important to control and determine CMP pad conditioner effectiveness (i.e., determining how well the conditioning wheel is conditioning the polishing pad.) For example, after extended use, a conditioning wheel may become worn and incapable of properly conditioning the polishing pad. When this occurs, if undetected, wafers may be polished with an undesirably conditioned polishing pad.

Generally, a variety of known techniques may be used to determine CMP pad conditioner effectiveness. One method comprises monitoring the polish removal rate of the polishing pad. For example, by measuring the pre-polish thickness and the post-polish thickness of a process layer of a wafer, the polish removal rate of the polishing pad may be determined. Typically, with this method, a decrease in the polish removal rate of the polishing pad may be used to signal a decrease in CMP pad conditioner effectiveness.

In addition to polish removal rate, post-polish non-uniformity of a wafer may be used to determine CMP pad conditioner effectiveness. Generally, the post-polish non-uniformity of a wafer increases as the conditioning wheel becomes worn and is in need of replacing. For example, after extended use, the conditioning wheel may inadequately condition portions of the polishing pad, and the inadequately conditioned portions of the polishing pad may increase the surface non-uniformity of subsequently polished wafers.

Another method of determining CMP pad conditioner effectiveness comprises measuring the thickness of the polishing pad after a predetermined amount of conditioning time. For example, the post-conditioned thickness of the polishing pad may be compared with the pre-conditioned thickness to determine the "cut rate" of the conditioning process. Those skilled in the art will appreciate that a decrease in the cut rate of the conditioning process may be used to signal a decrease in the CMP pad conditioner effectiveness.

The existing methods of determining CMP pad conditioner effectiveness, however, suffer from several shortcomings. For example, with the existing techniques, the conditioning wheel may be used to condition a polishing pad until the polish removal rate declines or the surface non-uniformity of polished wafers increases. When this occurs, because of the degraded polishing process, wafers that were polished with the improperly conditioned polishing pad may have to be reworked, which may add significant time and cost to the semiconductor manufacturing process. In addition, when measuring cut rate of a conditioning process, the polishing tool is typically removed from production, thus, decreasing throughput of the manufacturing process.

The present invention is directed to overcoming, or at least reducing the effects of, one or more of the problems set forth above.

SUMMARY OF THE INVENTION

In one aspect of the present invention, a method is provided. The method includes supplying a signal to rotationally drive a conditioning wheel of a conditioning tool. A polishing pad of a polishing tool is conditioned using the rotationally driven conditioning wheel. Changes in the signal driving the conditioning wheel during the conditioning process are monitored. A conditioning effectiveness of the conditioning wheel is determined based on the changes observed in the monitored signal.

In another aspect of the present invention, a system is provided. The system includes a conditioning tool and a controller. The conditioning tool is adapted to condition a polishing pad of a polishing tool. The controller is coupled to at least one of the polishing tool or the conditioning tool. The controller is adapted to supply a signal to rotationally drive a conditioning wheel of the conditioning tool, monitor changes in the signal driving the conditioning wheel during a conditioning process, and determine a conditioning effectiveness of the conditioning wheel based on changes observed in the monitored signal.

BRIEF DESCRIPTION OF THE DRAWINGS

The invention may be best understood by reference to the following description taken in conjunction with the accompanying drawings, in which like reference numerals identify like elements, and in which.

Figure 1:
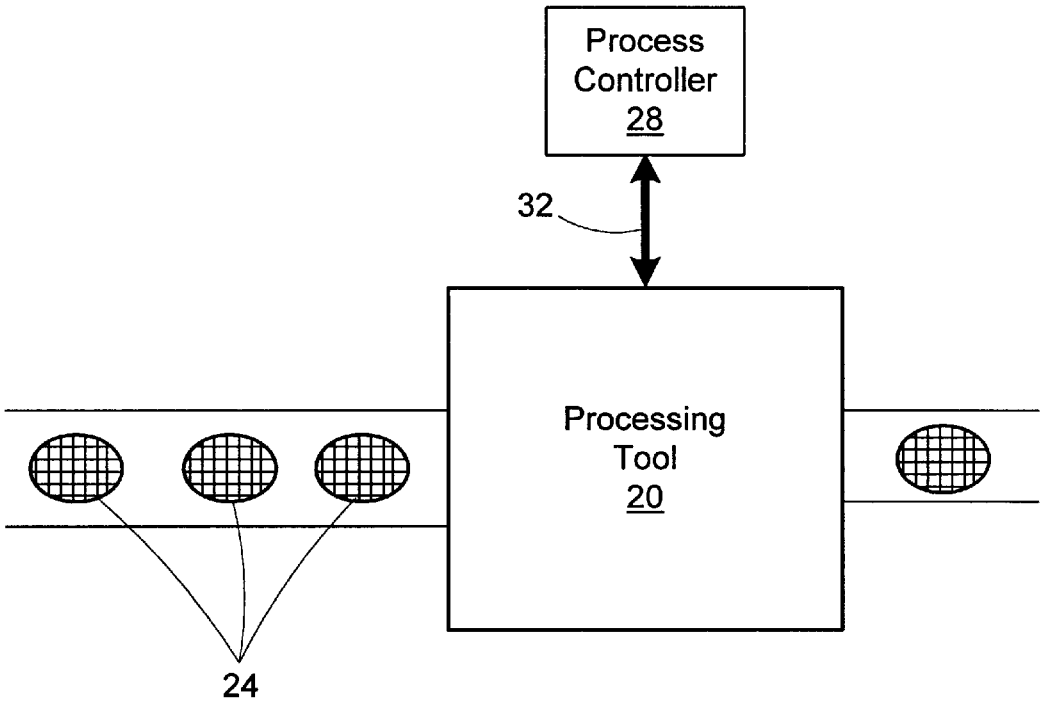
FIG. 1 is a simplified block diagram of a processing tool used to manufacture semiconductor devices.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention is directed to a method and apparatus for determining CMP pad conditioner effectiveness. In disclosing the present invention, reference will be made to the illustrative embodiment of the invention depicted in FIGS. 1–9. The relative sizes of the various features depicted in the drawings may be exaggerated or reduced as compared to the size of those feature sizes on actual devices. Nevertheless, the attached drawings are included to aid in obtaining an understanding of the present invention.

Referring to FIG. 1, an exemplary processing tool 20 is shown. The processing tool 20 may be used as one part of a fabrication process to manufacture semiconductor wafers 24 into functional semiconductor devices. The processing tool 20 may be controlled by a process controller 28 that may send a plurality of control signals to the processing tool on a control line 32. The process controller 28 may be comprised of a variety of devices. For example, in one embodiment, the process controller 28 may be a controller embedded inside the processing tool 20 and communicate with the processing tool 20 using protocols and interfaces provided by the manufacturer. Alternatively, the process controller 28 may be connected to a larger network of controllers and communicate with the processing tool 20 through an Advanced Process Control (APC) framework interface. For example, the processing tool 20 may be coupled to an equipment interface (not shown) that retrieves various operational data from the processing tool 20 and communicates this data to the Advanced Process Control (APC) framework. Moreover, the equipment interface may receive control signals from the APC framework that may be used to control the processing tool 20.

The semiconductor wafers 24 are generally processed in batches, which are commonly referred to as lots or batch processing. For example, a lot of wafers 24 may be comprised of twenty-five wafers. The wafers 24 within a lot progress through the manufacturing process together in an attempt to subject the wafers 24 to substantially the same manufacturing conditions, such that the resulting semiconductor devices have substantially the same performance characteristics (e.g., speed, power, etc.).

Figure 2:
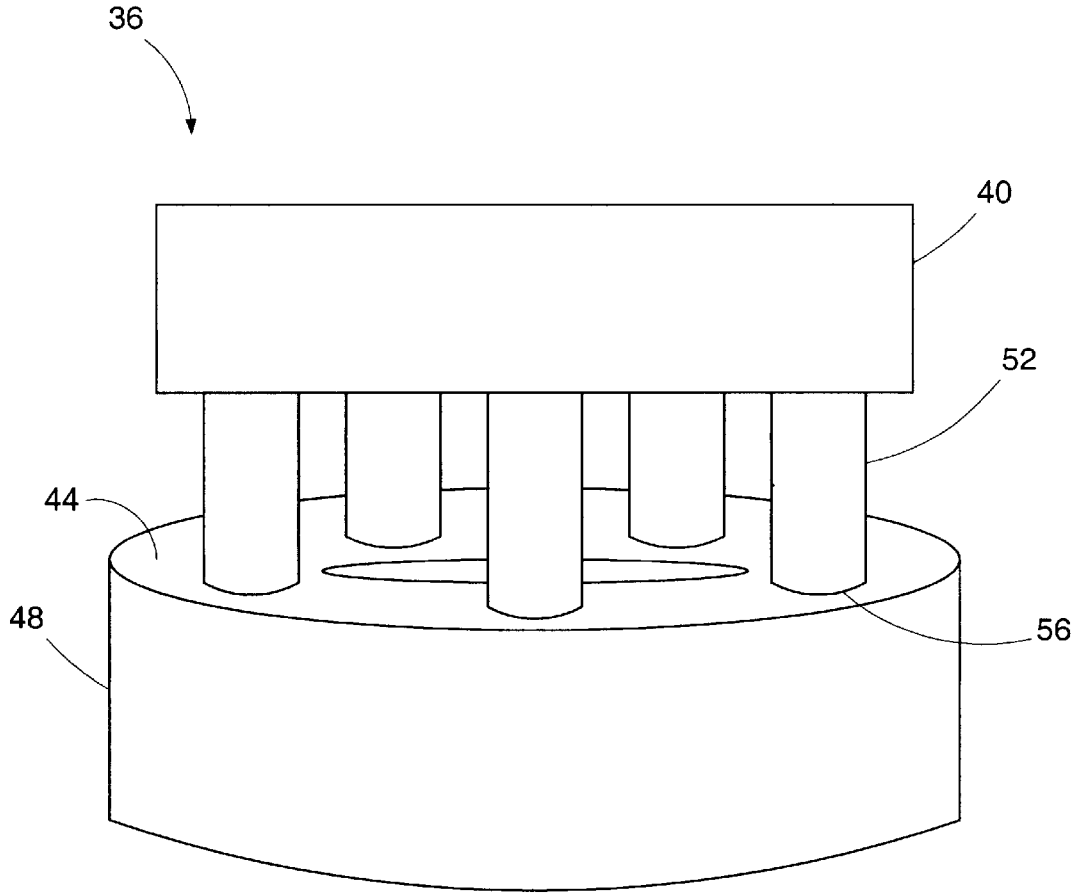
Figure 2 (Prior Art)
FIG. 2 illustrates a conventional polishing tool having multiple arms.

Referring to FIG. 2, an exemplary multiple arm polishing tool 36 is shown. The exemplary polishing tool 36 may be comprised of a multi-head carrier 40 positioned above a polishing pad 44 that is mounted on a rotateable platen 48. The multi-head carrier 40 typically includes a plurality of rotateable polishing arms 52, each of which includes a carrier head 56. Wafers (not shown) may be secured to the carrier heads 56 using known techniques, such as vacuum pressure. A source of polishing fluid (not shown) may be provided to supply polishing fluid (e.g., slurry) to the polishing pad 44. Furthermore, although five polishing arms 52 are shown, the polishing tool 36 may be comprised of any number of polishing arms 52. For example, in one embodiment, the polishing tool 36 is comprised of only a single polishing arm 52, and each wafer is polished individually.

Figure 3:
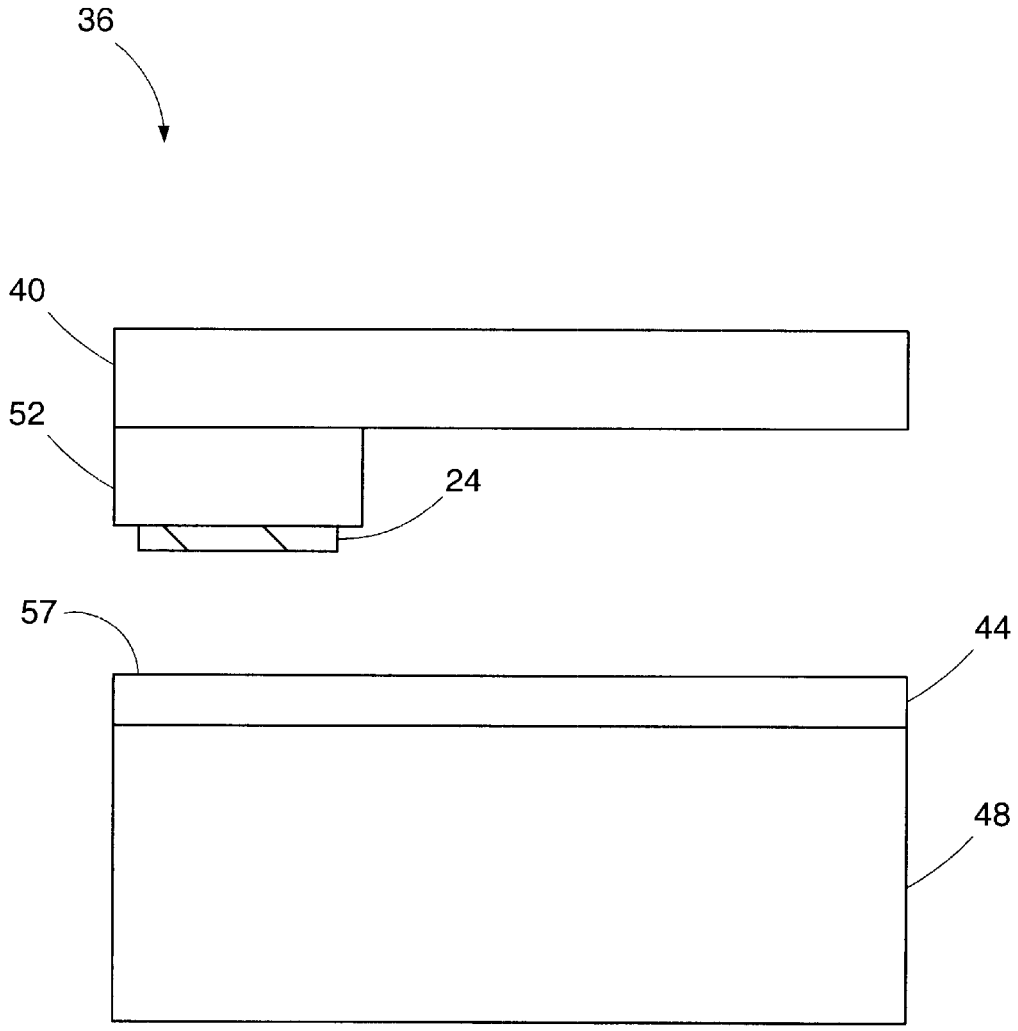
Figure 3 (Prior Art)
FIG. 3 is a simplified side-view of the polishing tool illustrated in FIG. 2.

Referring to FIG. 3, a simplified side-view of the illustrative polishing tool 36 is shown. To simplify understanding the operation of the polishing tool 36, only one polishing arm 52 is illustrated. Again, the polishing pad 44 may be fixed to the rotatable platen 48. The wafer 24 is connected to the rotatable polishing arm 52, using for example vacuum pressure, and the polishing arm 52 may be connected to the carrier 40. To effectuate polishing, the polishing arm 52 may be extended such that the wafer 24 is pressed against a surface 57 of the polishing pad 44, and the platen 48 may be rotated, typically at a constant speed. Moreover, a variable downward force may be applied to the polishing arm 52, and the polishing arm 52 may be rotated and oscillated back and forth across the polishing pad 44.

Figure 4:
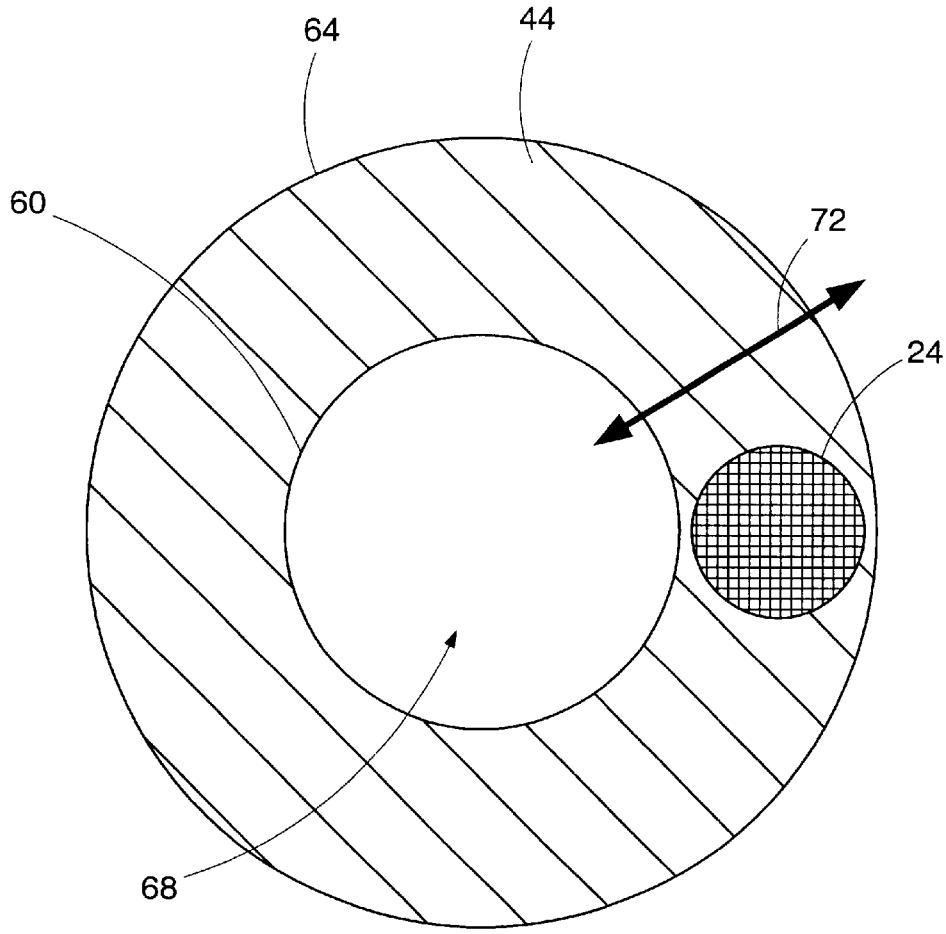
Figure 4 (Prior Art)
FIG. 4 is a simplified top-view of the polishing tool, shown in FIG. 2.

Referring to FIG. 4, a top-view of the polishing pad 44, illustrated in FIGS. 2 and 3, is shown. The polishing pad 44 may include an inner edge 60, an outer edge 64, and have an opening 68 positioned therein. Moreover, the wafer 24 is shown positioned against the polishing pad 44 between the inner and outer edge 60, 64. For simplicity, the polishing arms 52 and other elements of the polishing tool 36 are not shown. In addition, those skilled in the art will appreciate that a plurality of wafers 24 may be polished at the same time, and that FIG. 4 is a simplified view of the polishing pad 44.

During the polishing process, the wafer 24 may oscillate back and forth across the polishing pad 44. The direction of the oscillation is indicated by arrow 72. Normally, the oscillation length may be adjusted such that a portion of the wafer 24 moves slightly off the inner edge 60 of the polishing pad 44 at the minimum point of oscillation and slightly off the outer edge 64 of the polishing pad 44 at the maximum point of oscillation. Moreover, the oscillation length may be adjusted, and by increasing or decreasing the portion of the wafer 24 that moves off of the polishing pad 44 at the minimum and maximum points of oscillation, the center-to-edge polish rate may be adjusted.

As the wafer 24 is polished, material may be abraded away from the surface of the wafer 24 and deposited on the surface 57 of the polishing pad 44. The build up of waste material on the polishing surface 57 of the polishing pad 44 is generally referred to as glazing. If not removed, the glazing of the polishing pad 44 may degrade the polishing effectiveness of the polishing pad 44. For example, the build up of waste material may reduce the polish removal rate of the polishing pad 44 and/or increase the surface non-uniformity of polished wafers 24.

Figure 5:
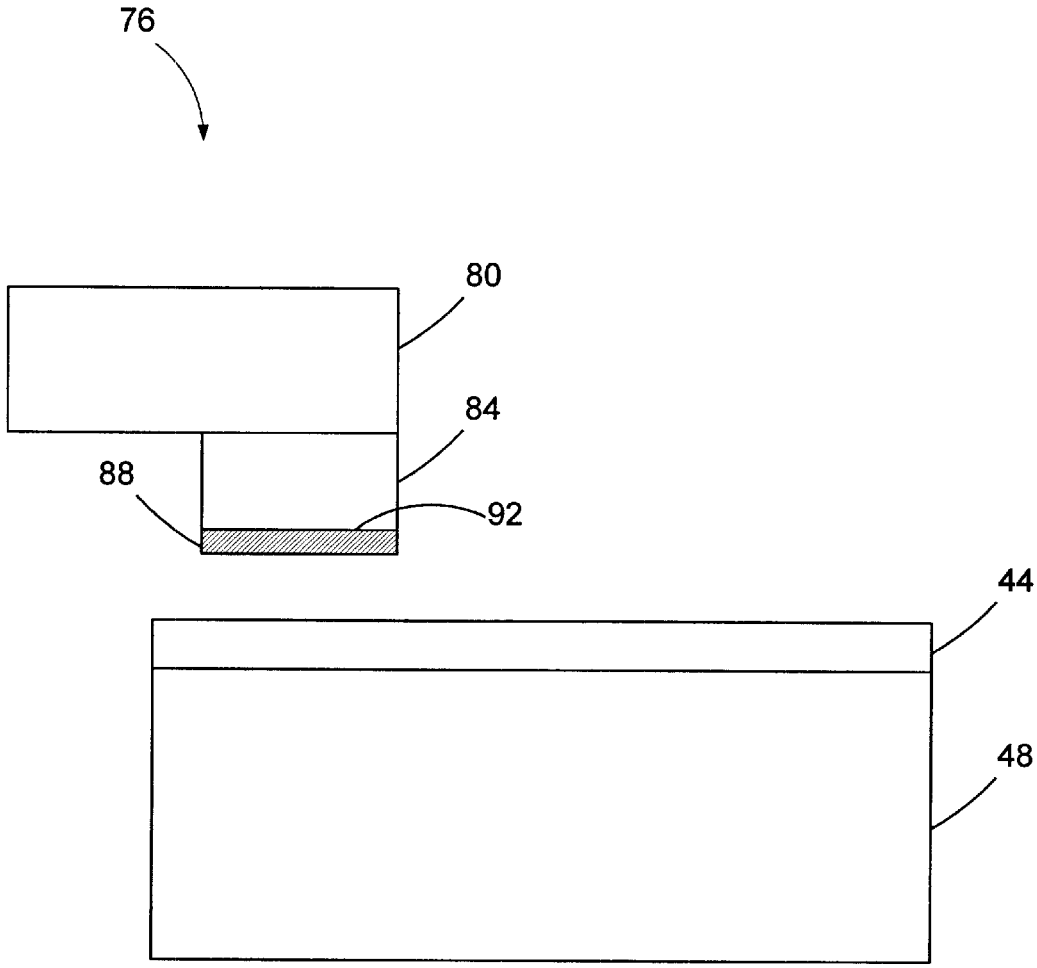
FIG. 5 is a simplified side-view of an illustrative conditioning tool used in conjunction with the polishing tool of FIG. 2 in accordance with one aspect of the present invention.

Referring to FIG. 5, a simplified side view of an illustrative conditioning tool 76 is shown. To simplify understanding the operation of the conditioning tool 76, the complexity of the illustration has been reduced. Moreover, other configurations and implementations of the conditioning tool 76 may be used with the present invention. In this illustrative embodiment, the conditioning tool 76 is comprised of a conditioning carrier 80, a conditioning arm 84, and a conditioning wheel 88. Generally, the conditioning wheel 88 may be comprised of a variety of abrasive materials. For example, the conditioning wheel 88 may be a diamond impregnated plate, and the sharp edges of the impregnated diamonds may be used to abrade the surface of the polishing pad 44.

In one embodiment, the conditioning tool 76 may be included as part of the polishing tool 36, described in FIGS. 2 and 3. For example, depending upon the particular embodiment, the conditioning tool 76 may not be a separate apparatus, but rather, a feature of the polishing tool 36. With this arrangement, the conditioning tool 76 is attached to the polishing tool 36, and when conditioning of the polishing pad 44 is desired, the conditioning tool 76 may be maneuvered into a desired position above the polishing pad 44.

In another embodiment, the conditioning 76 tool may be a separate apparatus, which may not be permanently fixed to the polishing tool 36. With this configuration, the conditioning tool 76 may be capable of being moved between different polishing tools 36. Generally, with either embodiment of the conditioning tool 76, when not in use, the conditioning carrier may be maneuvered away from the polishing pad 44 (i.e., the conditioning carrier 80 may be capable of swiveling away from above the polishing pad 44.)

In one embodiment, the conditioning arm 84 may be coupled with a conditioning motor (not show) that may be located inside the conditioning carrier 80. Generally, during a conditioning process, the conditioning motor may be driven to rotate the conditioning arm 84 in a circular direction. Moreover, because the conditioning wheel 88 is fixed to the conditioning arm 84, the circular movement of the conditioning arm 84 may also rotate the conditioning wheel 88. Furthermore, during a conditioning process, the conditioning arm 84 may extended down toward the polishing pad 44, and the conditioning wheel 88 may be positioned against the polishing pad 44. Once against the polishing pad 44, a variable downward force may be applied to the conditioning arm 84, and the conditioning wheel 88 may be rotated and oscillated back and forth across the polishing pad 44.

Figure 6:
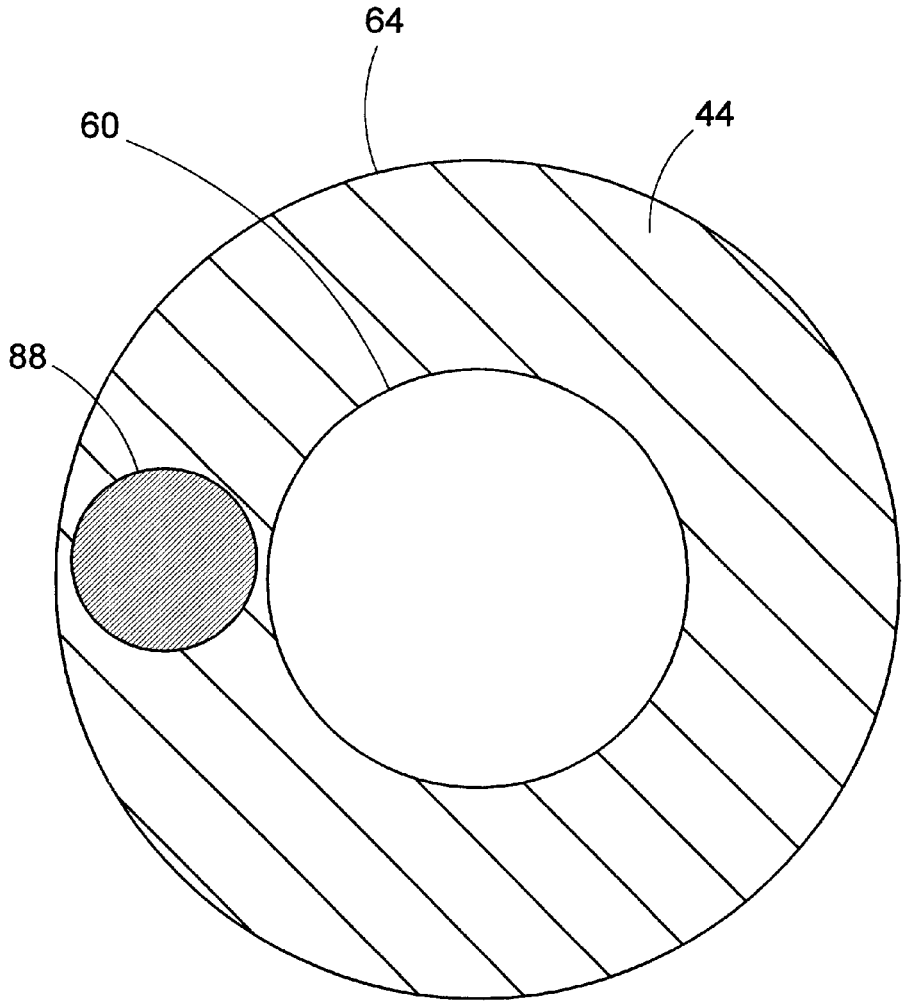
FIG. 6 is a simplified top-view of the polishing tool illustrated in FIG. 5 having a conditioning wheel positioned thereon.

Referring to FIG. 6, a top-view of the polishing pad 44 is shown. The conditioning wheel 88 is positioned between the inner and outer edge 60, 64 of the polishing pad 44. For simplicity, other elements of the conditioning tool 76 are not shown. Those skilled in the art will appreciate that, to reduce the undesirable effects of glazing, the conditioning wheel 88 may be rotated and oscillated back and forth across the polishing pad 44. For example, in one embodiment, a signal may be provided to the conditioning motor to drive the rotation of the conditioning wheel 88. During a conditioning process, the rotation of the conditioning wheel 88 may be used to condition the polishing pad 44 (i.e., the rotation of the conditioning wheel 88 may be used to remove the waste material from the surface of the polishing pad 44.) In addition to rotating the conditioning wheel 88, the platen 48 of the polishing tool 36 may also be rotated during the conditioning process.

In another embodiment, the conditioning motor may not drive the rotation of the conditioning wheel 88. Rather, the conditioning wheel 88 may be designed to free spin on an end 92 (shown in FIG. 5) of the conditioning arm 84. With this arrangement, the conditioning wheel 88 may be positioned against the polishing pad 44, and rotating the platen 48 of the polishing tool 36 may drive the rotation of the conditioning wheel 88. For example, a signal may be provided to a polishing motor (not shown) of the polishing tool 36, which may drive the rotation of the platen 48. Because the conditioning wheel 88 is positioned against the polishing pad 44, the rotation of the platen 48 may cause the conditioning wheel 88 to rotate. Once rotating, the conditioning wheel 88 may be used to condition the polishing pad 44. Moreover, as will be described below, with either embodiment, the CMP pad conditioner effectiveness may be determined by monitoring the signal provided to drive the rotation of the conditioning wheel 88.

Figure 7:
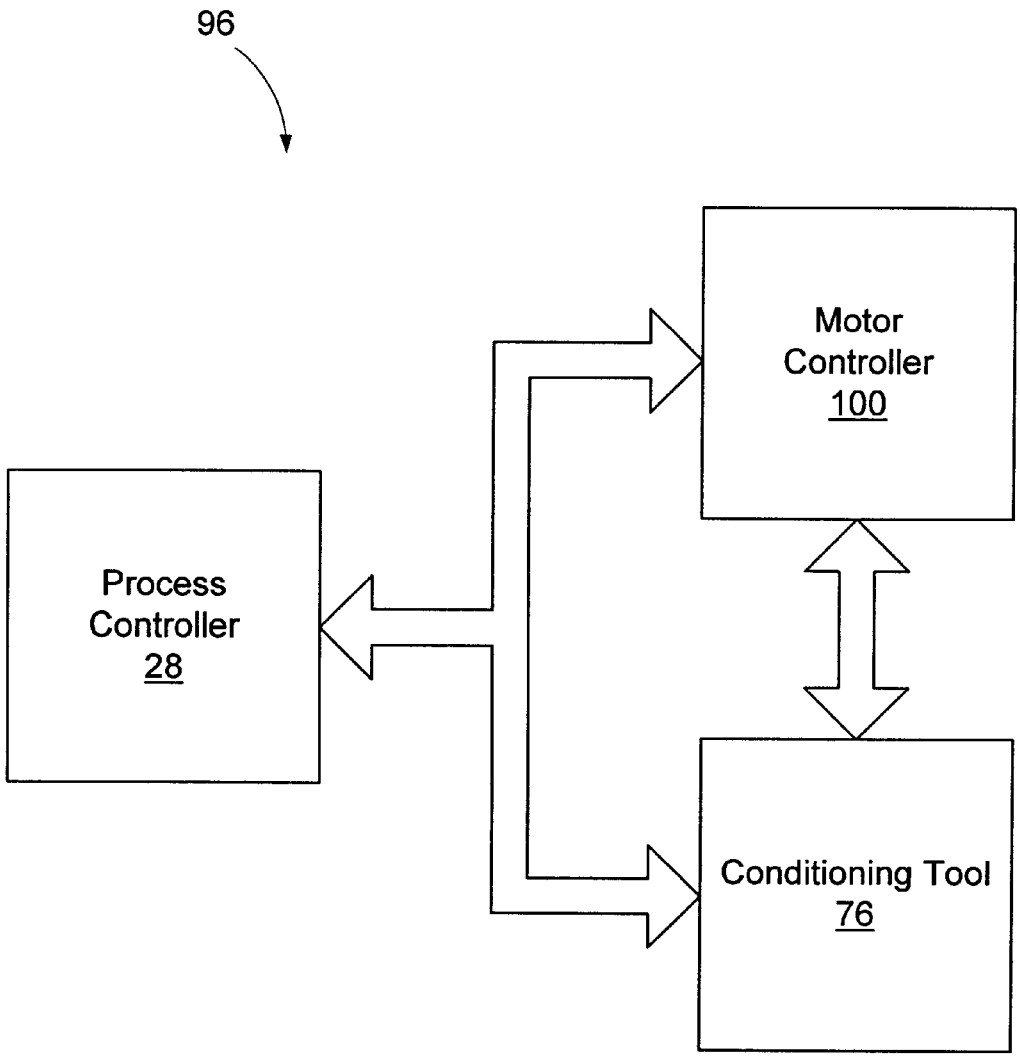
FIG. 7 is a simplified block diagram illustrating one exemplary control scheme of the conditioning tool illustrated in FIG. 5 in accordance with one aspect of the present invention.

Referring to FIG. 7, an exemplary control system 96 for the conditioning tool 76 is shown. Generally, a variety of control systems may be used with the present invention. Furthermore, because any number control systems may be implemented, the exemplary control system 96 described herein should not be considered as a limitation of the present invention.

In this illustrative embodiment, the control system 96 may be comprised of the process controller 28 and a motor controller 100. The process controller 28 may be capable of communicating with both the conditioning tool 76 and the motor controller 100. Furthermore, the process controller 28 may be used to implement the appropriate processing parameters for a particular conditioning process. For example, the process controller 28 may determine the duration of the conditioning process, the angular velocity of the conditioning wheel 88 and/or platen 48, the down force of the conditioning arm 84, and as will be described below the CMP pad conditioner effectiveness.

The motor controller 100 may be used to drive the conditioning motor of the conditioning tool 76. Furthermore, although not illustrated, the motor controller 100 may also be used drive the polishing motor of the polishing tool 36. For example, as described above, in one embodiment, the rotation of the platen 48 may be used to drive the rotation of the conditioning wheel 88. Moreover, depending upon the configuration, the motor controller 100 may supply a signal to either the conditioning tool 76 or the polishing tool 36 to rotate the conditioning wheel 88 at a desired angular velocity. For example, in one embodiment, the motor controller 100 may supply current to the conditioning motor and/or the polishing motor, which may be used to drive the circular rotation of the conditioning wheel 88.

Although the motor controller 100 is illustrated as a discrete component of the control system 96, the motor controller 100 may be implemented within the process controller 28. For example, the functionality of the motor controller 100 may be included within the process controller 28. With this embodiment, the process controller 28 may supply the signal or signals that control the rotation of the conditioning wheel 88. Moreover, as described above, the control system 96 for the conditioning and polishing tools 76, 36 may be provided by the manufacture of the polishing tool 36. Alternatively, the control system 96 for the conditioning tool 76 may be a separate system designed to work separately or in conjunction with the polishing tool 36.

In one embodiment, the control system 96 may be implemented using a programmable computer (not shown.) For example, the programmable computer may include a personal computer, a workstation, a network server, a mainframe computer, or the like. The computer may communicate with the conditioning and polishing tools 76, 36 using a variety of know bus systems, and operate under any suitable operating systems, such as Windows®, MS-DOS, OS/2, UNIX, or the like. Furthermore, the computer may be programmed to execute an application software package whose instructions may be encoded on a computer-readable program storage device, such as a floppy disk. Moreover, the instructions may be included on the hard disk of the computer or other storage medium. More particularly, the computer may be programmed to implement the process of FIG. 8.

Figure 8:
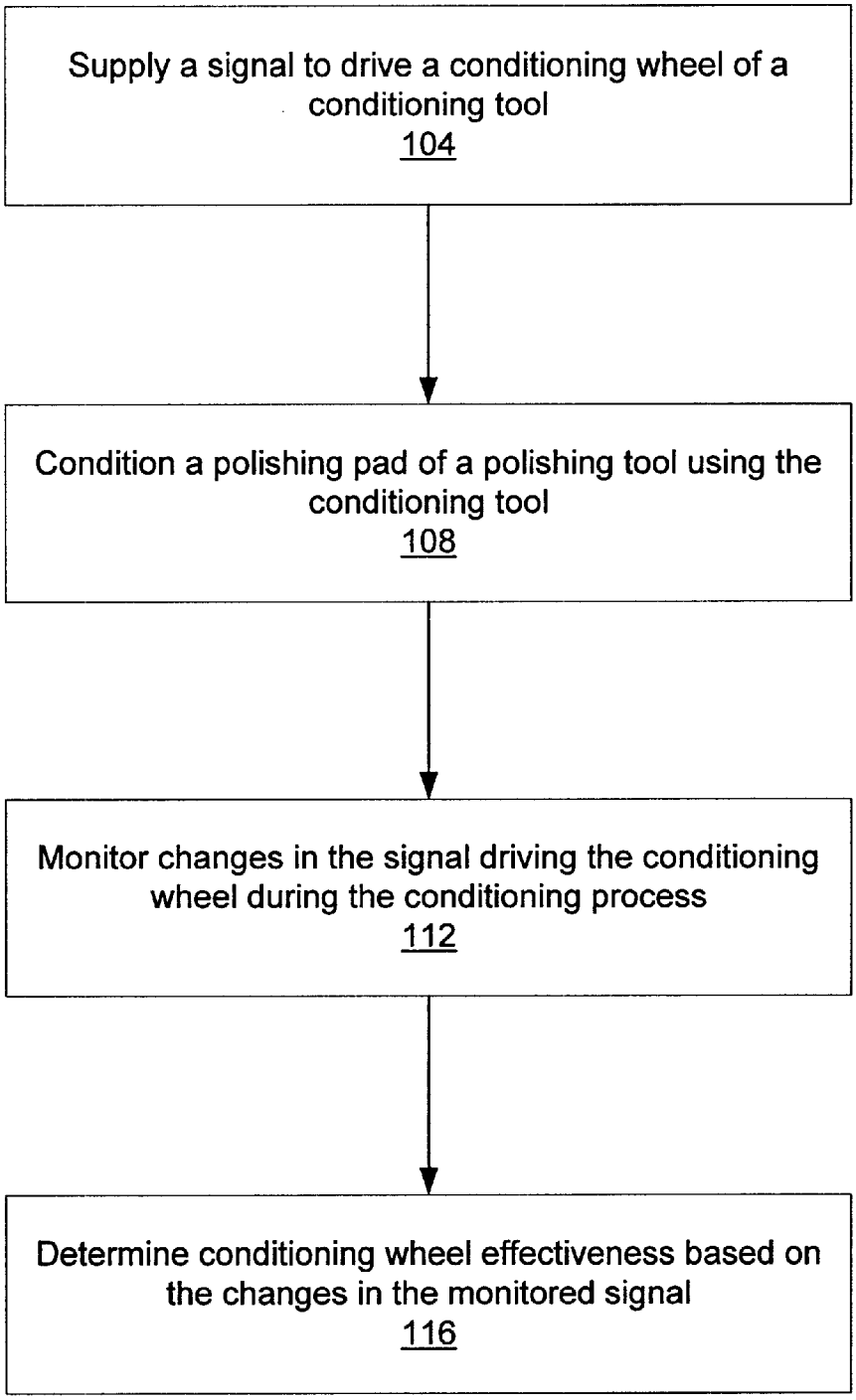
FIG. 8 is a functional block diagram of the methods taught by the present invention.

Referring to FIG. 8, an exemplary process for determining CMP pad conditioner effectiveness is shown. For ease of illustration and not of limitation, the exemplary process will be described with reference to the control system 96, illustrated in FIG. 7.

At block 104, a signal may be provided to drive the rotation of the conditioning wheel 88. In the illustrative examples described above, the rotation of the conditioning wheel 88 may be driven by the conditioning motor and/or the polishing motor. However, depending upon the configuration of the conditioning tool 76, other devices or configurations may be used to drive the rotation of the conditioning wheel 88. Nevertheless, even though many different configurations of the conditioning tool 76 may exist, a signal may be provided to an apparatus (e.g., conditioning motor, polishing motor, etc.) driving the rotation of the conditioning wheel 88.

In one embodiment, during a conditioning process, a signal is provided to the conditioning motor of the conditioning tool 76. The signal may be used to control the conditioning motor, which drives the rotation of the conditioning wheel 88. For example, the motor controller 100 may supply current (e.g., conditioner current) to the conditioning motor to produce the desired angular velocity of the conditioning wheel 88.

Generally, during the conditioning process, a coefficient of friction exists between the conditioning wheel 88 and the polishing pad 44. The coefficient of friction may vary depending upon, among other things, the amount of glazing of the polishing pad 44, the characteristics of the conditioning wheel 88 (e.g., age, composition, type, etc.), and the like. Depending upon the coefficient of friction, the motor controller 100 may adjust the conditioning current to produce the desired angular velocity for a particular conditioning process. For example, with high coefficients of friction, additional conditioning current may be provided to produce the desired angular velocity of the conditioning wheel 88. Alternatively, with low coefficients of friction, reduced conditioning current may be provided to produce the desired angular velocity.

In another embodiment, to effectuate the conditioning process, the motor controller 100 may provide the conditioning current to the polishing motor, which may be used to rotate the platen 48 of the polishing tool 36. With this embodiment, as was discussed for the conditioning motor, the current provided to the polishing motor may be adjusted, by the motor controller 100, to produce the desired angular velocity of the conditioning wheel 88. For example, the conditioning current may be increased or decreased depending upon the coefficient of friction. Moreover, as will be described below, by monitoring changes in the. signal provided by the motor controller 100 during the conditioning process, the CMP pad conditioner effectiveness may be determined.

At block 108, the polishing pad 44 of the polishing tool 36 may be conditioned. As discussed above, the conditioning wheel 88 may be used during a conditioning process to abrade away waste material from the surface of the polishing pad 44. Generally, during the conditioning process, the conditioning wheel 88 is positioned against the polishing pad 44, and the signal, discussed at block 104, may be provided to drive the rotation of the conditioning wheel 88. The conditioning parameters, such as processing time, angular velocity, conditioning arm down force, etc., may vary depending upon the particular process. However, the duration of a conventional conditioning process may be approximately 20–60 seconds.

In one embodiment, the polishing pad 44 is conditioned between polishing runs. For example, with the polishing tool 36, illustrated in FIG. 2, five wafers 24 may be polished during a first polishing run. Once these wafers 24 are polished, the polishing pad 44 may be conditioned with the conditioning tool 76. After conditioning, five additional wafers 24 may then be polished during a second polishing run. Alternatively, some polishing tools 36 are designed for in situ conditioning of the polishing pad 44. For example, the polishing pad 44 may be conditioned simultaneously while polishing wafers 24. With this configuration, the polishing arms 52 are arranged such that the conditioning wheel 88 may also be positioned against the polishing pad 44 during the polishing process.

At block 112, the signal provided to effectuate the rotation of the conditioning wheel 88 may be monitored during the conditioning process. As discussed above, the motor controller 100 or any other controlling device may supply a signal that drives the rotation of the conditioning wheel 88. In one embodiment, the motor controller 100 supplies a conditioning current that drives the rotation of the conditioning wheel 88. The conditioning current or any other signal may be monitored using a variety of known techniques. For example, the process controller 28 or the motor controller 100 may be used to directly "sense" the conditioning current. In addition, signal-monitoring devices may be incorporated into both the polishing tool 36 and the conditioning tool 76. Moreover, these devices may be used to actively monitor the signal driving the rotation of the conditioning wheel 88, and this data may be provided to and stored by the process controller 28. Alternatively, other devices, such as Hall effect probes or clamp on sensors may be attached to the signal supply lines (not shown), and the data from these measuring devices may be provided to and stored by the process controller 28.

At block 116, the process controller 28 may determine the conditioning wheel effectiveness based on changes observed in the monitored signal. For example, in one embodiment, the conditioning wheel 88 may be rotated at a substantially constant velocity during the conditioning process. Depending upon the coefficient of friction between the conditioning wheel 88 and the polishing pad 44, incremental adjustments may be made to the signal to maintain the constant angular velocity. Generally, after several conditioning processes, the conditioning wheel 88 may begin to wear, which may reduce its abrasive characteristics. When this occurs, the coefficient of friction between the conditioning wheel 88 and the polishing pad 44 may be reduced. Moreover, because of the reduced coefficient of friction, the desired angular velocity of the conditioning wheel 88 may be achieved using less conditioning current. After a sufficient period of time, the magnitude of the conditioning current may be reduced beyond a predetermined threshold, which may be used to signal an unacceptable conditioning pad effectiveness.

Figure 9:
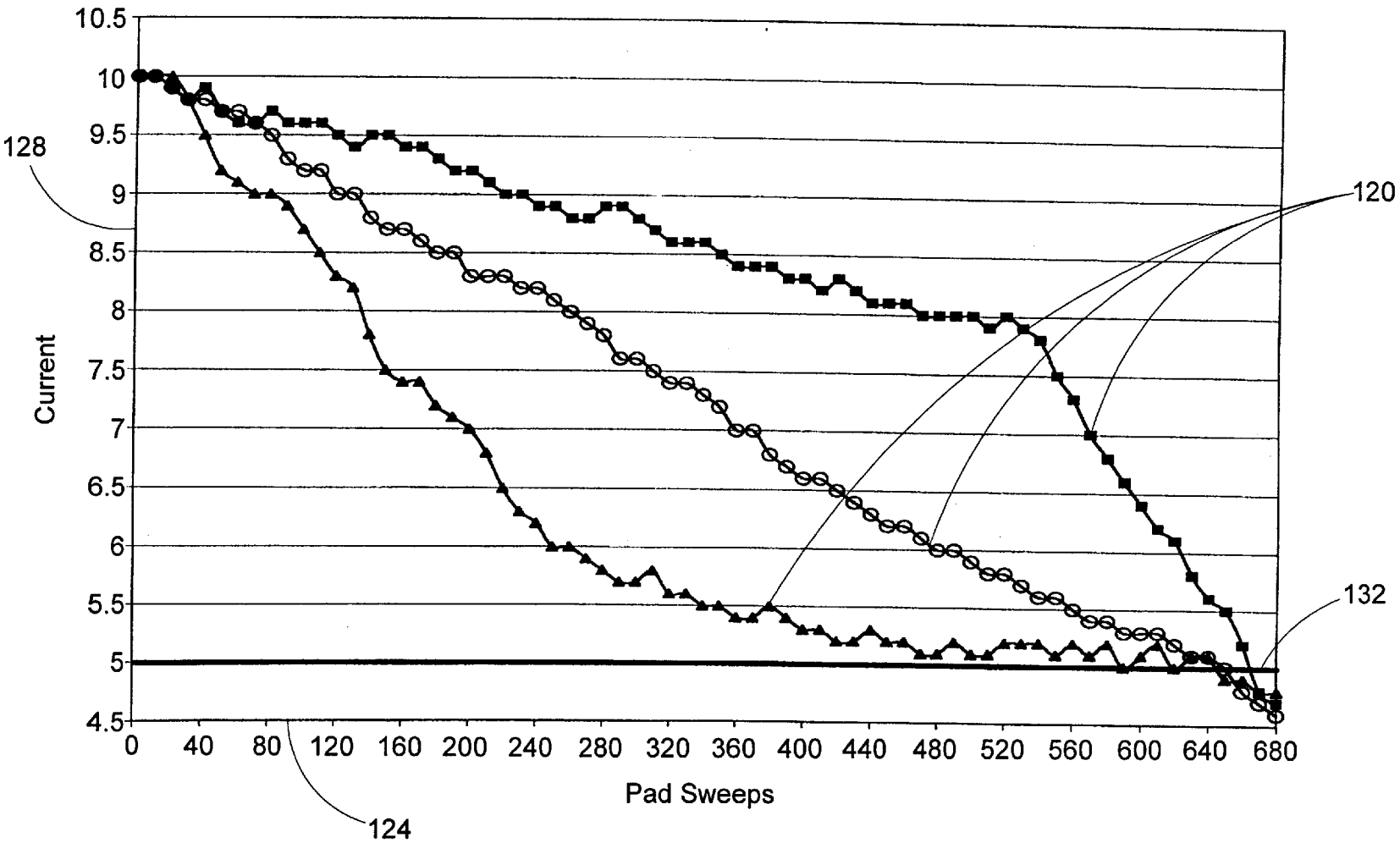
FIG. 9 is a graph illustrating one aspect of the functional block diagram of FIG. 8.

Referring to FIG. 9, a graph illustrating several exemplary signal curves 120 is shown. These exemplary curves 120 may be generated from data gathered by monitoring the signal driving the rotation of the conditioning wheel 88 over many conditioning cycles. Alternatively, the signal may be monitored and evaluated over a single conditioning process. In the graph, a first axis 124 represents the cumulative number of conditioning processes, and a second axis 128 represents the magnitude of the monitored signal. Each of the curves 120 may be used to illustrate exemplary data for different conditioning wheels 88. As discussed above, because the coefficient of friction may be high when the conditioning wheel 88 is new, more conditioning current may be supplied to drive the rotation of the conditioning wheel 88. However, as the conditioning wheel 88 begins to wear, it may lose its abrasive properties, and the monitored signal may approach a minimum threshold, which is illustrated by line 132.

The minimum threshold may be varied depending upon the particular process. For example, with very sensitive manufacturing processes, the minimum threshold may be increased, thus, requiring the conditioning wheel 88 to be replaced more often. Alternatively, with less sensitive processes, the minimum threshold may be reduced, and the conditioning wheel 88 may be replaced less often.

Once the process controller 28 has determined that the signal has dropped below the minimum threshold, a variety of actions may be taken. For example, the process controller 28 may shut down the conditioning tool 76, generate an alert signal, send a notification email, etc. There may be many advantages of determining CMP pad conditioner effectiveness using the monitored signal. For example, by monitoring the signal provided to rotate the conditioning wheel 88, the polishing tool 76 is not removed from production, and the CMP pad conditioner effectiveness may be determined in real time. Furthermore, the minimum threshold may be set such that production wafers do not have to be reworked after a sufficiently worn conditioning wheel 88 is detected.

Generally, other characteristics of the monitored signal may be used to determine the effectiveness of the conditioning wheel 88. For example, as shown in FIG. 9, the monitored signal data may be plotted, and the slope of the resulting curve may be analyzed. With this technique, significant increases or decreases in the slope of the curves 120 may be used to determine whether the conditioning wheel 88 is effectively conditioning the polishing pad 44. Furthermore, distinguishing peaks and/or valleys in the data may be used to determine how well the conditioning wheel 88 is conditioning the polishing pad 44.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method, comprising:

supplying a signal to rotationally drive a conditioning wheel of a conditioning tool;

conditioning a polishing pad of a polishing tool using the rotationally driven conditioning wheel;

monitoring changes in the signal driving the conditioning wheel during the conditioning process; and determining a conditioning effectiveness of the conditioning wheel based on changes observed in the monitored signal.

2. The method of claim 1, wherein supplying a signal to drive the conditioning wheel comprises supplying a conditioning current to a conditioning motor of the conditioning tool.

3. The method of claim 1, wherein supplying a signal to drive the conditioning wheel comprises supplying a conditioning current to a polishing motor of the polishing tool.

4. The method of claim 3, wherein conditioning the polishing pad comprises:

pressing the conditioning wheel against the polishing pad;

rotating the polishing pad in a circular direction using the conditioning current supplied to the polishing motor; and driving the conditioning wheel in a circular direction using the rotation of the polishing pad.

5. The method of claim 1, wherein monitoring changes in the signal driving the rotation of the conditioning wheel comprises monitoring the signal during a plurality of conditioning processes.

6. The method of claim 1, wherein monitoring the signal driving the conditioning wheel comprises:

collecting data related to the signal driving the rotation of the conditioning wheel; and providing the collected data to a process controller.

7. The method of claim 6, wherein monitoring the signal driving the conditioning wheel comprises determining a magnitude of the signal.

8. The method of claim 7, wherein determining a conditioning effectiveness of the conditioning wheel comprises determining that the conditioning effectiveness is insufficient once the magnitude of the signal has dropped below a predetermined minimum threshold.

9. The method of claim 8, wherein determining a conditioning effectiveness of the conditioning wheel comprises increasing the predetermined minimum threshold for certain manufacturing processes.

10. The method of claim 8, wherein determining a conditioning effectiveness of the conditioning wheel comprises decreasing the predetermined minimum threshold for certain manufacturing processes.

11. The method of claim 1, further comprising:

generating an alert signal once the conditioning effectiveness of the conditioning wheel is determined to be insufficient.

12. The method of claim 1, wherein determining a conditioning effectiveness of the conditioning wheel comprises:

rotating the conditioning wheel at a substantially constant angular velocity;

incrementally adjusting the signal driving the conditioning wheel to maintain the substantially constant angular velocity; and determining that the conditioning effectiveness of the conditioning wheel is insufficient once a magnitude of the signal has dropped below a predetermined minimum threshold.

13. The method of claim 1, further comprising:

replacing a first conditioning wheel with a second conditioning wheel once the conditioning effectiveness of the first conditioning wheel is determined to be insufficient.

14. A method, comprising:

supplying a conditioning current to a conditioning motor to rotationally drive a conditioning wheel of a conditioning tool;

conditioning a polishing pad of a polishing tool using the rotationally driven conditioning wheel;

monitoring changes in the signal driving the conditioning wheel during the conditioning process; and determining a conditioning effectiveness of the conditioning wheel based on changes observed in the monitored signal.

15. The method of claim 14, wherein monitoring the signal driving the conditioning wheel comprises determining a magnitude of the conditioning current.

16. The method of claim 14, wherein determining a conditioning effectiveness of the conditioning wheel comprises determining that the conditioning effectiveness is insufficient once the magnitude of the conditioning current has dropped below a predetermined minimum threshold.

17. A method, comprising:

supplying a conditioning current to a polishing motor of a polishing tool to rotationally drive a conditioning wheel of a conditioning tool;

conditioning a polishing pad of a polishing tool using the rotationally driven conditioning wheel;

monitoring changes in the signal driving the conditioning wheel during the conditioning process; and determining a conditioning effectiveness of the conditioning wheel based on changes observed in the monitored signal.

18. The method of claim 17, wherein conditioning the polishing pad comprises:

pressing the conditioning wheel against the polishing pad;

rotating the polishing pad in a circular direction using the conditioning current supplied to the polishing motor; and driving the conditioning wheel in a circular direction using the rotation of the polishing pad.

19. The method of claim 17, wherein monitoring the signal driving the conditioning wheel comprises determining a magnitude of the conditioning current.

20. The method of claim 19, wherein determining a conditioning effectiveness of the conditioning wheel comprises determining that the conditioning effectiveness is insufficient once the magnitude of the conditioning current has dropped below a predetermined minimum threshold.

21. A system, comprising:

a conditioning tool adapted to condition a polishing pad of a polishing tool; and a controller coupled to at least one of the polishing tool or the conditioning tool, the controller being adapted to:

supply a signal to rotationally drive a conditioning wheel of the conditioning tool;

monitor changes in the signal driving the conditioning wheel during a conditioning process; and determine a conditioning effectiveness of the conditioning wheel based on changes observed in the monitored signal.

22. The system of claim 21, further comprising:

a conditioning motor adapted to receive a conditioning current from the controller and rotationally drive the conditioning wheel in response to the conditioning current received.

23. The system of claim 21, further comprising:

a polishing motor adapted to receive a conditioning current from the controller and rotationally drive a platen of the polishing tool in response to the conditioning current received.

24. The system of claim 21, further comprising:

at least one measuring device that is adapted to:

collect data related to the signal driving the rotation of the conditioning wheel; and provide the collected data to the controller.

25. The system of claim 21, further comprising:

a motor controller that is adapted to provide a conditioning current to the conditioning tool.

26. The system of claim 21, wherein the process controller is adapted to monitor changes in the signal driving the conditioning wheel during a plurality of conditioning processes.

27. The system of claim 21, wherein the process controller is adapted to determine a magnitude of the signal.

28. The system of claim 27, wherein the process controller is adapted to determine that the conditioning effectiveness of the conditioning wheel is insufficient once the magnitude of the signal has dropped below a predetermined minimum threshold.

29. The system of claim 28, wherein the process controller is adapted to increase the predetermined minimum threshold for certain manufacturing processes.

30. The system of claim 28, wherein the process controller is adapted to decrease the predetermined minimum threshold for certain manufacturing processes.

31. The system of claim 21, wherein the process controller is adapted to generate an alert signal once the conditioning effectiveness of the conditioning wheel is determined to be insufficient.

32. The system of claim 21, wherein the process controller is adapted to:

rotate the conditioning wheel at a substantially constant angular velocity;

incrementally adjust the signal driving the conditioning wheel to maintain the substantially constant angular velocity; and determine that the conditioning effectiveness of the conditioning wheel is insufficient once a magnitude of the signal had dropped below a predetermined minimum threshold.

33. A system, comprising:

means for supplying a signal to rotationally drive a conditioning wheel of a conditioning tool;

means for conditioning a polishing pad of a polishing tool using the conditioning tool;

means for monitoring changes in the signal driving the conditioning wheel during the conditioning process; and means for determining a conditioning effectiveness of the conditioning wheel based on changes observed in the monitored signal.

* * * * *